US008936091B2

(12) United States Patent
Dudnichenko et al.

(10) Patent No.: US 8,936,091 B2
(45) Date of Patent: Jan. 20, 2015

(54) WELL JET PUMPING ASSEMBLY FOR DEGASSING COAL BEDS

(76) Inventors: Boris Anatolievich Dudnichenko, Ivano-Frankovsk (UA); Aleksandr Miroslavovich Karasevich, Moscow (RU); Aleksandr Viktorovich Kejbal, Moscow (RU); Zinoviy Dmitrievich Khomynets, Moscow (RU)

( * ) Notice: Subject to any disclaimer, the term of this patent is extended or adjusted under 35 U.S.C. 154(b) by 637 days.

(21) Appl. No.: 13/145,111

(22) PCT Filed: Dec. 16, 2009

(86) PCT No.: PCT/RU2009/000693

§ 371 (c)(1),
(2), (4) Date: Jul. 19, 2011

(87) PCT Pub. No.: WO2010/087738

PCT Pub. Date: Aug. 5, 2010

(65) Prior Publication Data

US 2011/0272047 A1 Nov. 10, 2011

(51) Int. Cl.

| | |
|---|---|
| ***E21B 17/14*** | (2006.01) |
| ***E21B 43/16*** | (2006.01) |
| ***E21B 43/00*** | (2006.01) |
| ***E21B 43/12*** | (2006.01) |

(52) U.S. Cl.

CPC ..... *E21B 43/006* (2013.01); *E21B 43/124* (2013.01)

USPC ..... 166/309; 166/372; 166/242.8; 417/151

(58) Field of Classification Search

USPC ..... 166/309, 369, 372, 242.8, 105.5; 137/565.22, 895; 417/151

See application file for complete search history.

(56) References Cited

U.S. PATENT DOCUMENTS

| | | | | |
|---|---|---|---|---|
| 2,652,000 | A * | 9/1953 | Woolsey | 166/105.5 |
| 4,531,593 | A * | 7/1985 | Elliott et al. | 175/71 |
| 4,988,389 | A * | 1/1991 | Adamache et al. | 166/302 |
| 5,662,167 | A * | 9/1997 | Patterson et al. | 166/265 |
| 7,007,759 | B2 * | 3/2006 | Harrington et al. | 166/372 |
| 7,077,208 | B2 * | 7/2006 | Harrington et al. | 210/747.8 |
| 2003/0141073 | A1 * | 7/2003 | Kelley | 166/372 |
| 2003/0221836 | A1 * | 12/2003 | Gardes | 166/369 |
| 2006/0049234 | A1 * | 3/2006 | Flak et al. | 228/112.1 |
| 2007/0000841 | A1 * | 1/2007 | Harrington et al. | 210/703 |
| 2007/0039729 | A1 * | 2/2007 | Watson et al. | 166/245 |

* cited by examiner

*Primary Examiner* — Catherine Loikith

(74) *Attorney, Agent, or Firm* — patenttm.us

(57) ABSTRACT

A jet pump mounts on a pipe string in a well passing through coal beds. The pipe string length is greater than the lower coal bed occurrence depth. A carrying ring, with filtering shoe attached on a switcher, mounts below the lower bed floor. A carrying ring with bypass ports mounts on the string above the upper bed roof. A packer mounts on the string below the ports above the upper bed roof. A pump housing with a removable insert seat, having a nozzle and a mixing chamber with diffuser, mounts on the ring. The housing has a working fluid and exhausted fluid mixture draining channel and an exhausted fluid supplying channel, provided with a check valve. The housing connects to a working fluid supply pipe provided on the upper end with a sealing element disposed on the ring, and an inlet funnel receiving the removable insert.

1 Claim, 1 Drawing Sheet

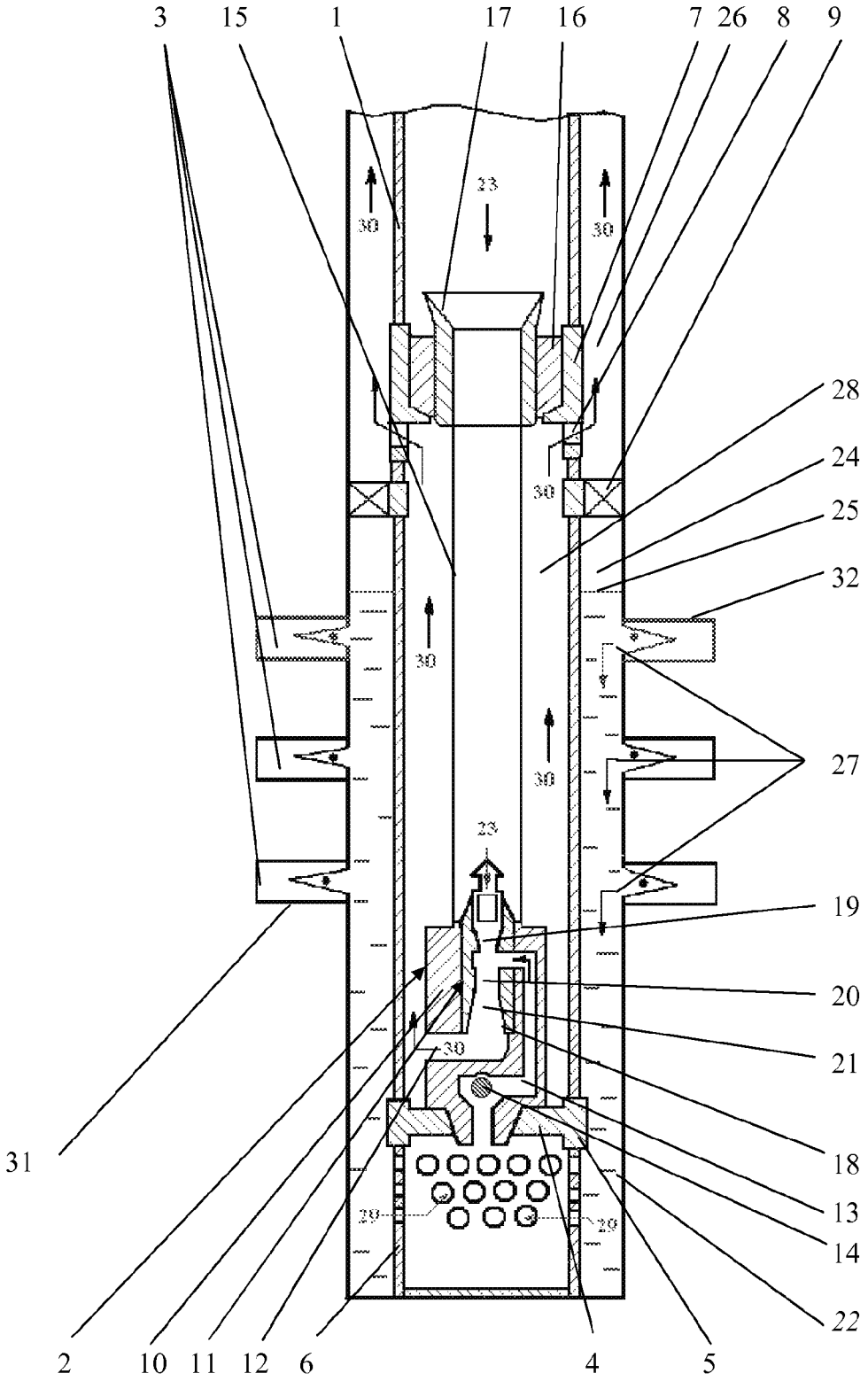
3
15
1
17
16
7
26
8
9
23
30
28
24
25
32
27
19
20
21
18
13
14
22
31
29
2
10
11
12
6
4
5

WELL JET PUMPING ASSEMBLY FOR DEGASSING COAL BEDS

FIELD OF THE INVENTION

The invention relates to jet engineering and may be used for bottomhole pumping in wells, including those intended for producing methane from gas-bearing coal beds by degassing them.

DESCRIPTION OF PRIOR ART

A well jet pumping unit is known, which comprises an electric centrifugal pump and a separator for separating a fluid pumped out of a well into a liquid medium and a gaseous medium, said pump and separator being arranged on a pipe string in well, wherein said liquid medium can be pumped out by the electric centrifugal pump and said gaseous medium is pumped out by the jet pumping unit SU 1550115, F04D 13/10, 03/15/1990).

However, this unit has a relatively low efficiency due to lowering the efficiency of the electric centrifugal pump because of forced withdrawal of a significant part of a liquid pumped by it for the purpose of operating the jet pumping unit.

The well unit for degassing coal beds (described in RU 2293833, 02/20/2007), comprising a pump arranged on a flow string going through coal beds, is accepted to be the closest prior art to this invention in terms of its technical essence and achieved result.

Coal-methane wells are characterized by that significant quantities of powdered coal, fine coal particles and a dissolved gas are contained in a pumped out formation water. Therefore, the use of electric-centrifugal pumps and sucker-rod pumps results in lowering their interrepair time and significantly increasing cost of produced methane.

SUMMARY OF THE INVENTION

The aim of this invention is to ensure the possibility of pumping both a liquid medium and a gaseous medium out of a well with the use of one pumping assembly, subject to its long-term operation.

The claimed technical effect consists in improving the operation efficiency of the well jet pumping assembly in the conditions of a liquid phase and a gaseous phase as well as solid mechanical impurities present in a fluid pumped out of a well, as well as in the conditions of ultra-law formation pressure.

The technical effect is achieved due to the fact that a well jet assembly for degassing coal beds comprises a pump arranged in a flow string going in a well through coal beds, said pump being a jet pump and arranged in an inner cavity of a lower portion of the flow string. The lower portion goes through The coal beds and has a length greater than a depth of occurrence of the lowermost coal bed. The well jet assembly further comprises a lower support ring with a filter-type shoe attached via a sub to a lower part of the lower support ring. The lower support ring is arranged on a lower portion of the flow string below the bottom boundary of the lowermost coal bed . The Well jet assembly further comprises an upper support ring with drain ports arranged on the flow string higher, above a top of the uppermost coal bed; a packer arranged on an outer surface of the flow string under the drain ports and above the top of the uppermost coal bed; and body of the jet pump arranged on the lower support ring. Said body is provided with: a seat for installing a removable insert with a nozzle and a mixing chamber with a diffuser; a channel for draining a mixture of a working fluid; and a channel for supplying a fluid pumped out of a well and having a check valve arranged therein. The body of the jet pump is connected, in its upper part, with a lower part of a pipe for supplying a working medium. The pipe for supplying the working medium is provided with a sealing element, wherein said sealing element is arranged on the upper support ring and an input hopper for receiving a removable insert.

Studies have been carried out, which show that there exists the possibility of pumping out a liquid medium and then a gaseous medium, in particular methane, from coal beds with the use of one well jet pumping assembly in the conditions of ultra-law formation pressure. No rearrangement of the equipment is needed. It has been found out that the jet pump can be most reasonably installed in the inner cavity of the lower portion of the flow string which goes through coal beds and which length is greater than the depth of occurrence of the lowermost coal bed. It is most reasonable when: the lower support ring, to which lower part a filter-type shoe is attached via a sub, is arranged on a lower portion of the flow string below the bottom boundary of the lowermost coal bed, the upper support ring with drain ports is arranged on the flow string higher, above the top of the uppermost coal bed, the packer is arranged on the outer surface of the flow string under the drain ports and above the top of the uppermost coal bed, the body of the jet pump is arranged on the lower support ring, said body being provided with: a seat for installing a removable insert having a nozzle and a mixing chamber with a diffuser, a channel for draining a mixture of a working fluid and a channel for supplying a fluid pumped out of a well, said channel for supplying the fluid pumped out of a well having a check valve arranged therein, and the body of the jet pump is connected, in its upper part, to the lower part of a pipe for supplying a working medium, the pipe being provided with a sealing element arranged on the upper support ring and an input hopper for receiving a removable insert.

All this enables to reduced fluid level below the lowermost coal bed in the under-packer area, thus contributing to degassing coal beds with ultra-low formation pressure. A short length of the pipe for supplying a working medium as compared to the length of a wellbore enables to create minor resistance while pumping the working medium through it that significantly reduces power inputs when operating the well jet assembly.

Presence of a filter-type shoe under the well-jet assembly provides for avoiding penetration of solid parts with the diameter comparable with the diameter of the channel for supplying a fluid pumped out of a well thus preventing from sealing the channel and failure of the well jet assembly.

The making of the well jet assembly with a lowered removable insert enables, if necessary, quickly replace it without lifting the whole flow string with the pumping assembly to the surface, which enables to increase the available time of the pumping assembly significantly and reduce its downtime and operation costs.

BRIEF DESCRIPTION OF THE DRAWINGS

The FIGURE schematically shows the inventive well jet assembly for degassing coal beds.

DESCRIPTION OF A BEST MODE FOR CARRYING OUT THE INVENTION

The well jet assembly for degassing of coal beds comprises a pump 2 arranged on a flow string 1 going in a well through coal beds, said pump being a jet pump and being arranged in the inner cavity of a lower portion of the flow string 1, which goes through coal beds 3 and which length is greater than the depth of occurrence of the bottom boundry 31 of the lowermost coal bed 3. The lower support ring 4, to which lower part a filter-type shoe 6 arrange in a dib hole 22 is attached via a sub 5, is arranged on a lower portion of the flow string 1 below the bottom boundary of the lowermost coal bed 3. The upper support ring 7 with drain ports 8 is arranged on the flow string 1 higher, above the top 32 of the uppermost coal bed 3, and a packer 9 is arranged on the outer surface of the flow string 1 under the drain ports 8 and above the top of the uppermost coal bed 3. The body 10 of the jet pump is arranged on the lower support ring 4, the said body being provided with: a seat 18 for installing a removable insert 11 having a nozzle 19 and a mixing chamber 20 with a diffuser 21, a channel 12 for draining a mixture 30 of a working fluid 23 and pumped out fluid 29 and a channel 13 for supplying a fluid pumped out of a well, this channel being provided with a check valve 14 arranged therein. The body 10 of the jet pump 2 is connected, in its upper part, to the lower part of a pipe 15 for supplying a working medium, the pipe 15 being provided with a sealing element 16 arranged on the upper support ring 7 and an input hopper 17 for receiving a removable insert 11.

The filter-type shoe 6 with the sub 5, the lower support ring 4, the packer 9 and the upper support ring 7 with the drain ports 8, which are arranged bottom-up on the flow string 1, are lowered into a well thereon.

The body 10 of the jet pump 2 is installed into the inner cavity of the flow string 1 during lowering into the well, the lower part of the body being hermetically arranged on the lower support ring 4, and then the pipe 15 for supplying a working agent, which is connected to the body 10, is installed with the sealing element 16 that is mounted on the upper support ring 7.

Then the removable insert 11 with the nozzle 19, the mixing chamber 20 and the diffuser 21 is dropped into the well, said insert 11 spontaneously arranging itself in the body 10 of the jet pump 2 during pumping a working agent 23 in the flow string 1.

Further, a working agent 23 is supplied under pressure via the flow string 1 and the pipe 15 for supplying a working agent to the nozzle 19 of the removable insert 11, thus creating depression in the under-packer area 24, the packer 9 being arranged above the uppermost coal bed 3. As a result, water 25 is drawn from the bottomhole via the channel 13 for supplying the medium pumped out of the well into the mixing chamber 20 of the insert 11 in the jet pump 2, where it is mixed with the jet flow of the working agent 23 and, together with the latter, is delivered via the channel 12, the annular space 28 around the pipe 15 and the drain ports 8 into the annular space 26 around the flow string 1 above the packer 9 and then comes to the surface via the said annular space 25. As the level of a liquid (water) 25 in the well decreases, coal gas 27 comes into the well form coal beds 3 forming with the water 25 a pumped out medium 29 which comes via the filter-type shoe 6 into the channel 13 for supplying the medium pumped out of the well and then into the mixing chamber 20, where after mixing with the working agent jet flow, it comes to the surface. Thus, the liquid 25 and the coal gas 27 in the form of a gas-water mixture are taken, and then said mixture is separated into fractions in a gas separator (not shown in the Figure) on the surface.

By changing the parameters of the removable insert 11 (e.g., the nozzle 19 diameter, and the mixing chamber 20 by replacement of the removable insert 11) and a working agent 23 pumping pressure in the jet pump 2 the operation parameters of the jet pump 2 may be easily optimized. Moreover, the coal gas 27 is supplied to the surface forcibly, which enables to increase its output.

If the removable insert 11 fails, or if the water flow rate of the well is increased significantly, then the removable insert 11 is extracted to the surface and is replaced to a more efficient one.

Industrial Applicability

The invention may be used in the coal industry during degassing coal beds.

What is claimed is:

1. A well jet assembly for degassing coal beds, the well jet assembly comprising a pump arranged in a flow string going in a well through coal beds, characterized in that the pump being a jet pump and arranged in an inner cavity of the lower portion of the flow string, which lower portion goes through coal beds and has a length is greater than a depth of occurrence of a bottom boundary of a lowermost coal bed, and a lower support ring with a filter-type shoe attached via a sub, to a lower part of the lower support ring, the lower support ring being arranged on a lower portion of the flow string below the bottom boundary of the lowermost coal bed, an upper support ring with drain ports is arranged on the flow string higher, above a top of an uppermost coal bed, a packer is arranged on an outer surface of the flow string under the drain ports and above the top of the uppermost coal bed, and a body of the jet pump is arranged on the lower support ring, said body provided with:

a seat for installing a removable insert with a nozzle and a mixing chamber with a diffuser, a channel for draining a mixture of a working fluid and pumped out fluid, and a channel for supplying a fluid pumped out of a well, and having a check valve arranged therein, wherein the body of the jet pump being connected, in its upper part, with the lower part of a pipe for supplying a working medium, said pipe being provided with a sealing element, said sealing element being arranged on the upper support ring and an input hopper for receiving the removable insert.

* * * * *